US008999111B2

(12) United States Patent
Castro et al.

(10) Patent No.: US 8,999,111 B2
(45) Date of Patent: Apr. 7, 2015

(54) METHOD OF INCREASING PAPER SURFACE STRENGTH BY USING ACRYLIC ACID/ACRYLAMIDE COPOLYMER IN A SIZE PRESS FORMULATION CONTAINING STARCH

(71) Applicants: David J Castro, DeKalb, IL (US); Mei Liu, Plainfield, IL (US); Gary S Furman, St. Charles, IL (US); Dorota Smoron, Hoffman Estates, IL (US); Shawnee M Wilson, Downers Grove, IL (US); Zhiyi Zhang, Naperville, IL (US)

(72) Inventors: David J Castro, DeKalb, IL (US); Mei Liu, Plainfield, IL (US); Gary S Furman, St. Charles, IL (US); Dorota Smoron, Hoffman Estates, IL (US); Shawnee M Wilson, Downers Grove, IL (US); Zhiyi Zhang, Naperville, IL (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 13/729,650

(22) Filed: Dec. 28, 2012

(65) Prior Publication Data

US 2014/0182799 A1 Jul. 3, 2014

(51) Int. Cl.

| | |
|---|---|
| ***D21H 19/10*** | (2006.01) |
| ***D21H 17/28*** | (2006.01) |
| ***C08L 3/00*** | (2006.01) |
| ***D21H 17/37*** | (2006.01) |
| ***D21H 23/56*** | (2006.01) |
| ***D21H 19/20*** | (2006.01) |
| ***D21H 19/54*** | (2006.01) |
| ***D21H 19/58*** | (2006.01) |
| ***D21H 21/18*** | (2006.01) |

(52) U.S. Cl.

CPC ..... *D21H 17/37* (2013.01); *D21H 23/56* (2013.01); *D21H 19/20* (2013.01); *D21H 19/54* (2013.01); *D21H 19/58* (2013.01); *D21H 21/18* (2013.01)

(58) Field of Classification Search

USPC ..... 162/135, 158, 168.1, 168.2, 168.3, 175, 162/181.1, 183, 184; 106/162.1, 206.1, 106/214.1–214.2, 215.1–215.2, 106/217.6–217.7; 127/32–34, 65, 67–71; 525/50, 55, 418, 540

See application file for complete search history.

(56) References Cited

U.S. PATENT DOCUMENTS

| | | | | |
|---|---|---|---|---|
| 3,640,925 | A * | 2/1972 | Maurer et al. | 524/734 |
| 4,146,515 | A * | 3/1979 | Buikema et al. | 524/610 |
| 5,851,655 | A * | 12/1998 | Tokiyoshi et al. | 428/330 |
| 6,746,542 | B1 * | 6/2004 | Lorencak et al. | 127/32 |
| 2003/0150573 | A1 * | 8/2003 | Anderson et al. | 162/158 |
| 2004/0171719 | A1 * | 9/2004 | Neivandt et al. | 426/658 |
| 2012/0111517 | A1 | 5/2012 | Borkar et al. | |

FOREIGN PATENT DOCUMENTS

| | | | |
|---|---|---|---|
| WO | 03087473 | A1 | 10/2003 |
| WO | 2005004812 | A2 | 1/2005 |
| WO | 2012042115 | A1 | 4/2012 |

OTHER PUBLICATIONS

Smook, Gary A., Handbook for Pulp and Paper Technologists, 2nd ed, Angus Wilde Publications, 1992, pp. 220, 283 and 288-292.*

(Continued)

*Primary Examiner* — Dennis Cordray
(74) *Attorney, Agent, or Firm* — Benjamin Carlsen

(57) ABSTRACT

The invention provides methods and compositions for increasing the strengthening effect of a starch coating on paper. The method involves contacting the starch with a synthetic polymer before the starch is cooked. This changes how the starch gelatinizes and how the polymer gets distributed on the paper resulting in greater paper surface strength.

10 Claims, 2 Drawing Sheets

(56) References Cited

OTHER PUBLICATIONS

BeMiller et al, "Starch", Ullmann's Encyclopedia of Industrial Chemistry, vol. 35, pp. 113-141, 2012.*

Definition of "complex", IUPAC. Compendium of Chemical Terminology, 2nd ed. (the "Gold Book"), 1997, [online], [retrieved on Jun. 24, 2014], Retrieved from the Internet: <URL: http://goldbook.iupac.org (2006-)>.*

International Search Report mailed Apr. 28, 2014 for related PCT application PCT/US2013/075469. (13 Pages).

* cited by examiner

METHOD OF INCREASING PAPER SURFACE STRENGTH BY USING ACRYLIC ACID/ACRYLAMIDE COPOLYMER IN A SIZE PRESS FORMULATION CONTAINING STARCH

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to compositions, methods, and apparatuses for improving paper surface strength. Paper is sheet material containing interconnected small, discrete fibers. The fibers are usually formed into a sheet on a fine screen from a dilute water suspension or slurry. Paper typically is made from cellulose fibers, although occasionally synthetic fibers are used.

As described in U.S. Pat. No. 5,585,456, paper products made from untreated cellulose fibers lose their strength rapidly when they become wet, i.e., they have very little wet strength. The wet strength of paper is defined as the resistance of the paper to rupture or disintegration when it is wetted with water. Wet strength of ordinary paper is only about 5% of its dry strength. To overcome this disadvantage, various methods of treating paper products have been employed.

One method of increasing the strength of paper is by the addition of a starch coating to the surface of paper. As described in U.S. Pat. No. 4,966,652, although originally applied to size (make resistant to water penetration) paper, starch coatings also increase the stiffness of paper. The increase in stiffness is so pronounced that it makes paper suitable for use in such applications as container board, packaging papers, and sheet fed printer papers. The starch is commonly added onto the paper sheet by an Can-machine process (such as a size press device) or an off-machine process.

As described for example in U.S. patent application Ser. No. 12/323,976, the high cost of paper fiber makes the strength enhancing process even more crucial. Increasingly paper manufacturers are adding significant amounts of less expensive filler materials to defray costs and to enhance other properties required in the paper such as whiteness and brightness. However, papermakers are limited in the amount of fillers in the final product due in great part to a net loss in strength. Tensile strength, z-directional tensile strength and the tendency of the paper to shed filler particles (dusting) during typical handling processes, e.g., printing, are some of the main properties affected. U.S. Pat. No. 7,488,403 describes a method of enhancing the strengthening effect by adding a glyoxylated polyacrylamide polymer to the paper sheet. However there remains a continuing need in the art for methods of imparting appropriate levels of wet strength to paper products.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

At least one embodiment of the invention is directed towards a method of coating a paper substrate. The method comprises the steps forming a composition by contacting starch and a synthetic polymer during a starch cooking process in a fluid under temperature and conditions sufficient to gelatinize the starch, and applying the composition to a paper substrate, the synthetic polymer not being a starch. The contact may occur after and/or before the starch cooking process has begun. The synthetic polymer may be a copolymer formed from monomer units of both acrylic acid and acrylamide. The starch may be a solid before it is cooked. The composition may have a viscosity greater than a composition in which the polymer only enters the composition after the starch has been cooked. The paper substrate may comprises filler particles and may have a greater surface strength than a paper product similarly made but in which a smaller amount of filler was present and the polymer was added to the composition after cooking. The composition may be applied to a paper substrate by one device selected from the list consisting of a size press device, print roll coater device, air-knife coater device, metering bar coater device, blade coater device, under vacuum coater device, cast coating device, and any combination thereof. A paper product made from the paper substrate may have a greater strength than a paper product made from the same materials but with a smaller amount of starch and in which the polymer was added to the composition after cooking.

Additional features and advantages are described herein, and will be apparent from, the following Detailed Description.

BRIEF DESCRIPTION OF THE DRAWINGS

A detailed description of the invention is hereafter described with specific reference being made to the drawings in which.

For the purposes of this disclosure, like reference numerals in the figures shall refer to like features unless otherwise indicated. The drawings are only an exemplification of the principles of the invention and are not intended to limit the invention to the particular embodiments illustrated.

DETAILED DESCRIPTION OF THE INVENTION

Figure 1:
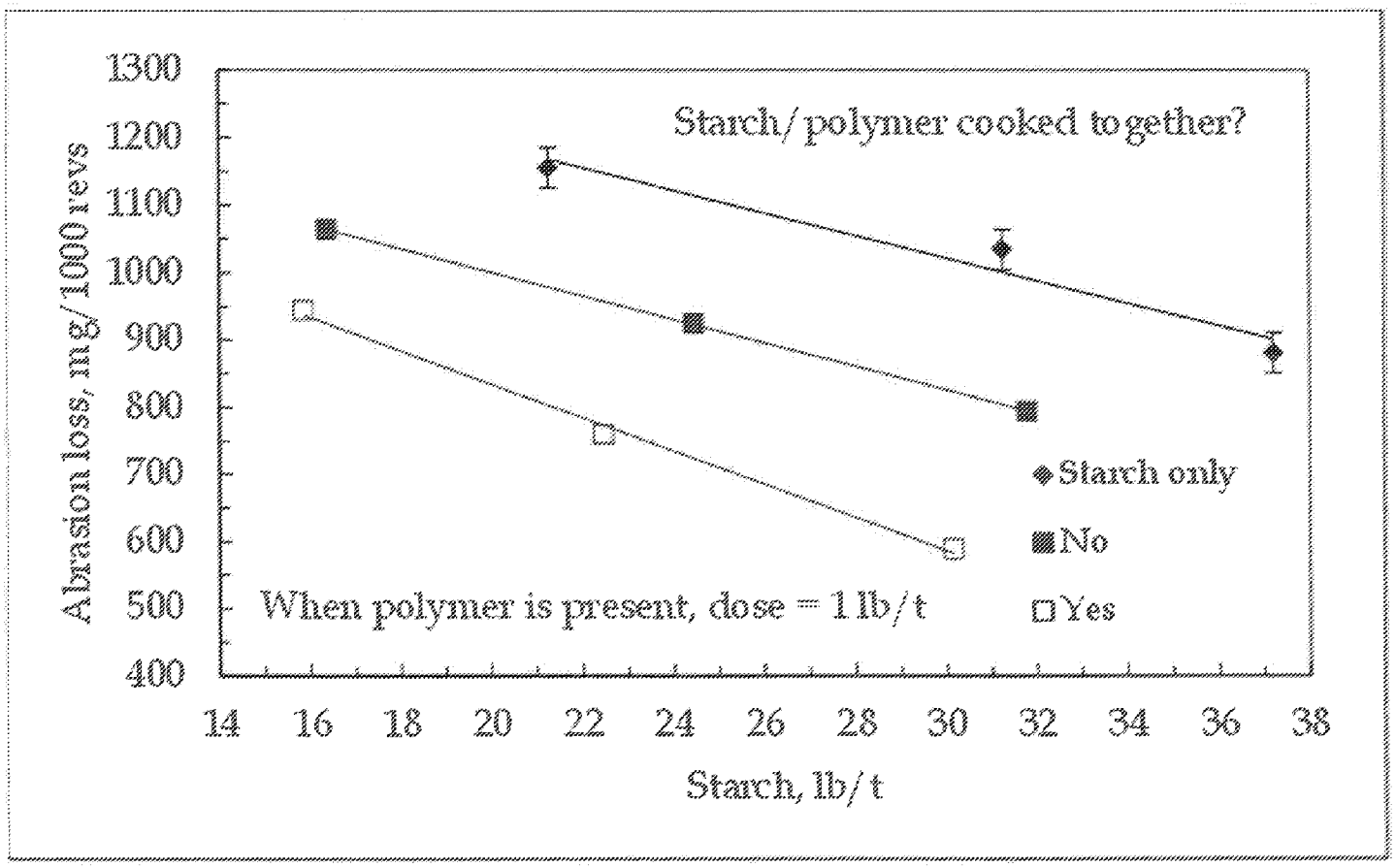
FIG. 1 is a graph illustrating how the invention improves the strength of a paper sheet.

The following definitions are provided to determine how terms used in this application, and in particular how the claims, are to be construed. The organization of the definitions is for convenience only and is not intended to limit any of the definitions to any particular category.

"Consisting Essentially of" means that the methods and compositions may include additional steps, components, ingredients or the like, but only if the additional steps, components and/or ingredients do not materially alter the basic and novel characteristics of the claimed methods and compositions.

"Cooking" means applying thermal energy to a fluid giving it sufficient energy to accelerate the process of gelatinizing starch.

"Free," "No," "Substantially no" or "Substantially free" means a composition, mixture, or ingredient that does not contain a particular compound or to which a particular compound or a particular compound-containing compound has not been added.

"GCC" means ground calcium carbonate filler particles, which are manufactured by grinding naturally occurring calcium carbonate rock "Papermaking Process" means a method of making paper products from a pulp comprising forming an aqueous fibrous papermaking furnish from processed pulp typically comprising cellulose fibers, draining the furnish to form a wet sheet and drying the sheet to form a dry sheet. The steps of forming the papermaking furnish, draining, and drying may be carried out in any conventional manner generally known to those skilled in the art.

"Paper Substrate" means furnish, wet sheet, and/or dry sheet from a papermaking process.

"PCC" means precipitated calcium carbonate filler particles, which are synthetically produced.

"Pre-cooked Starch" means starch which is in such an insoluble form that when within water in the absence of cooking heat or other chemical agents, it is largely insoluble and can only be dispersed into a suspension.

"Polysaccharide" means a polymeric carbohydrate having a plurality of repeating units comprised of simple sugars, the C—O—C linkage formed between two such joined simple sugar units in a polysaccharide chain is called a glycosidic linkage, and continued condensation of monosaccharide units will result in polysaccharides, common polysaccharides are amylose and cellulose, both made up of glucose monomers, polysaccharides can have a straight chain or branched polymer backbone including one or more sugar monomers, common sugar monomers in polysaccharides include glucose, galactose, arabinose, mannose, fructose, rahmnose, and xylose.

"STP" means standard temperature and pressure.

"Surfactant" is a broad term which includes anionic, nonionic, cationic, and zwitterionic surfactants. Enabling descriptions of surfactants are stated in *Kirk-Othmer, Encyclopedia of Chemical Technology*, Third Edition, volume 8, pages 900-912, and in *McCutcheon's Emulsifiers and Detergents*, both of which are incorporated herein by reference, "Surface Strength" means resistance to loss of material due to abrasive forces applied along the surface of a substrate, one means of measuring surface strength is described in the test protocol in TAPPI 476.

"Suspension" means a thermodynamically unstable generally homogenous fluid containing an internal phase material dispersed throughout an external phase material, because the internal phase material does not dissolve in the external phase material, over time in the absence of some input of energy (such as mechanical agitation, excipients, or chemical suspending agents) the internal phase material will settle out, the external phase material may be a solid and often has a volume larger than 1 micrometer$^3$.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the Kirk-Othmer Encyclopedia of Chemical Technology, 5th Edition, (2005), (Published by Wiley, John & Sons, Inc.) this definition shall control how the term is to be defined in the claims.

At least one embodiment of the invention is directed towards a method of increasing the surface strengthening effect that a starch containing coating can impart to a sheet of paper. The method includes the steps of preparing a strengthening composition by cooking starch in the presence of a synthetic polymer in a fluid (such as water), allowing the synthetic polymer and starch to complex with each other in the presence of heat sufficient to increase the gelatinization of the starch in the fluid, and applying the composition to a sheet of paper.

In at least one embodiment the synthetic polymer contacts the starch before the starch has begun to be cooked. In at least one embodiment the synthetic polymer contacts the starch after the starch has begun to undergo a cooking process.

In at least one embodiment the pre-cooked starch and the synthetic polymer are kept in a non-cooking state for between 1 minute and 57 years prior to cooking.

In at least one embodiment the temperature of the non-cooking state is no greater than 30° C.

In at least one embodiment the temperature of the cooking process is between STP and 200° C.

In at least one embodiment the fluid the starch is cooked in is at least in part a liquid. In at least one embodiment the fluid the starch is cooked in is at least in part a gas. In at least one embodiment the fluid the starch is cooked in is at least in part water. In at least one embodiment the fluid the starch is cooked in is at least in part steam.

As described in the textbook *Handbook for Pulp & Paper Technologists* (7th Printing), by G. A. Smook, TAPPI (1982), (hereinafter "Smook") (generally and in particular in chapter 18), starch is stored and transported in a pre-cooked format. When pre-cooked, the starch is typically a white granular powder. This powder is largely insoluble in cold water because of its polymeric structure and because of hydrogen bonding between adjacent polymer chains. In order for it to be effective as a paper coating however, water needs to penetrate into the structure and thereby gelatinize the starch into a form suitable for coating. In the absence of an energy input (such as vigorous stirring over a long period of time or added heat) the hydrogen bonding resists and impairs water penetration and gelatinization occurs either extremely slowly or not at all. When an aqueous suspension of pre-cooked starch is heated or cooked, the water is able to penetrate into the structures and swell up and gelatinize the starch. Heating and cooling of the now cooked starch can be performed to obtain a desired viscosity appropriate for applying the starch with a coating device. Typically a starch composition is applied by a coating device when it has a low viscosity achieved by the composition being between 6-15% starch and 85-94% water.

In at least one embodiment the cooking process excludes applying a temperature or pressure so extreme as to chemically degrade either of the starch and/or the synthetic polymer.

As elegantly illustrated in Smook's FIGS. 18-5 and 18-6 (page 266), according to the prior art, starch is first cooked and only afterwards is combined with other chemical additives such as strengthening agents to form a composition applied by a coating process. It has however been discovered that by allowing starch to remain in contact with a synthetic polymer during the cooking process, the properties of the resulting cooked starch change. Among those changed properties are greater strengthening effect and a greater viscosity than if the starch and the polymer had come into contact with each other after the cooking process. In addition, because of the intense temperature and pressure effects of the cooking process and because of the specific conditions required to form synthetic polymers, it was not anticipated that synthetic polymers could survive the intense cooking process in a form which preserved their beneficial properties.

Figure 2:
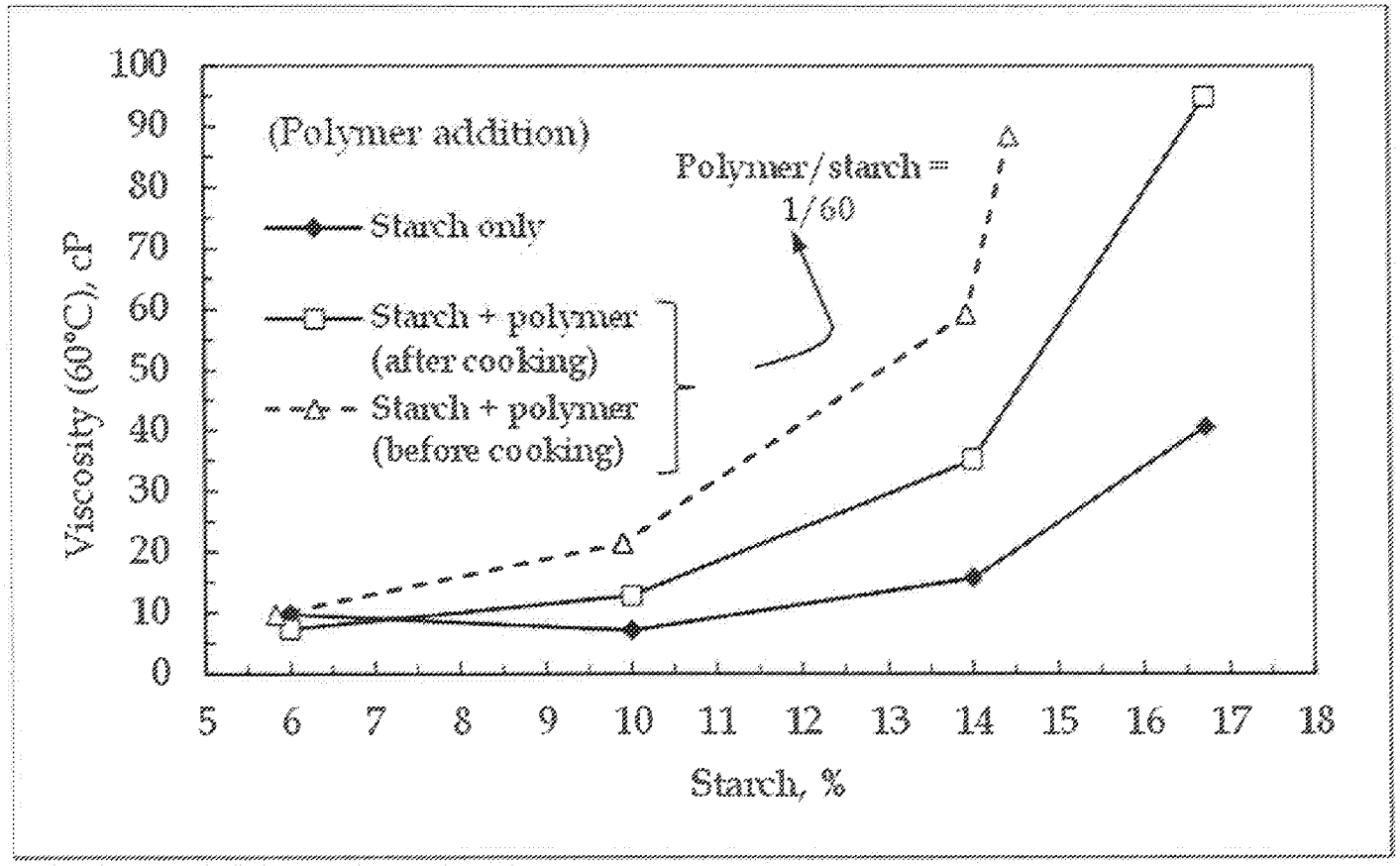
FIG. 2 is a graph illustrating how the invention increases the viscosity of a starch solution.

Without being limited by a particular theory or design of the invention or of the scope afforded in construing the claims, it is believed that when the starch and the synthetic polymer contact each other while being cooked together, they form a complex that does not otherwise form and that enhances the properties of the starch. This complex is believed to rely upon interactions too weak to form covalent bonds, but which holds the synthetic polymer and starch together by hydrogen bonds. In addition the altered geometry may change the configuration with which water can gelatinize the starch affecting its viscosity. As a result a starch cooked while in contact with a synthetic polymer is chemically different from cooked starch which has had a synthetic polymer added to it after the starch has been cooked. Objective evidence of these differences can be seen by the differences in viscosity shown in FIG. 2. These differences are believed to distribute the synthetic polymer relative to the paper sheet in a more beneficial manner.

In at least one embodiment the starch comprises: natural starch, modified starch, amylose, amylopectin, styrene-starch, butadiene starch, starches containing various amounts of amylose and amylopectin, such as 25% amylose and 75% amylopectin (corn starch) and 20% amylose and 80% amylopectin (potato starch); enzymatically treated starches; hydrolyzed starches; heated starches, also known in the art as "pasted starches"; cationic starches, such as those resulting from the reaction of a starch with a tertiary amine to form a quaternary ammonium salt; anionic starches; ampholytic starches (containing both cationic and anionic functionalities); cellulose and cellulose derived compounds; and any combination thereof and/or a combination thereof which explicitly excludes one or more of these. Some representative examples of starch can be found in U.S. Pat. Nos. 5,800,870, and 5,003,022.

In at least one embodiment the composition of the starch is such that but for the contact between the starch and the synthetic polymer during the cooking process, the composition would not have proper viscosity and/or proper strengthening properties.

In at least one embodiment the synthetic polymer is a copolymer, terpolymer, etc. . . . the polymer includes monomeric units of acrylic acid and acrylamide. Additional monomeric units that may be present in the synthetic polymer include one or more of cationic character conferring monomers and other vinyl monomers.

In at least one embodiment the synthetic polymer and/or the starch is linear, branched, cyclic, and/or hyperbranched.

In at least one embodiment the synthetic polymer excludes starch.

Representative cationic character conferring monomers include: diallyl quaternary monomer (generally diallyl dimethyl ammonium chloride, DADMAC), 2-vinylpyridine, 4-vinylpryridine, 2-methyl-5-vinyl pyridine, 2-vinyl-N-methylpyridinium chloride, p-vinylphenyl-trimethyl ammonium chloride, 2-(dimethylamino)ethyl methacrylate, trimethyl(p-vinylbenzyl)ammonium chloride, p-dimethylaminoethylstyrene, dimethylaminopropyl acrylamide, 2-methylacroyloxyethyltrimethyl ammonium methylsulfate, 3-acrylamido-3-methylbutyl trimethyl ammonium chloride, 2-(dimethylamino)ethyl acrylate, and mixtures thereof. In addition to chloride, the counterion for the cationic monomers also can be fluoride, bromide, iodide, sulfate, methylsulfate, phosphate, and the like, and any combination thereof.

Other vinyl monomers that can be present during preparation of the synthetic polymer include: acrylic esters such as ethyl acrylate, methylmethacrylate and the like, acrylonitrile, vinyl acetate, N-vinyl pyrrolidone, N,N'-dimethyl acrylamide, hydroxy alkyl(meth)acrylates, styrene and the like, allylglycidal ether, glycidyl methacrylate, co-monomers with a 1,2-diol in their structure, such as 3-allyloxy-1,2-propandiol, 3-acryloyloxy-1,2-propandiol and methacryloyloxy-1,2-propandiol, and the like, and any combination thereof.

In at least one embodiment glyoxal is also present when the starch and the synthetic polymer are cooked together. In at least one embodiment a glyoxyated polyacrylamide polymer is present when the pre-cooked starch and the synthetic polymer are contacted. In at least one embodiment the synthetic polymer or the material that is contacted with the cooking starch is one or more of those compositions described in one or more of U.S. Pat. Nos. 4,966,652, 5,320,711, 5,849,154, 6,013,359, 7,119,148, 7,488,403, 7,589,153, 7,863,395, 7,897,103, 8,025,924, 8,101,046, 8,163,134, and 8,273,215.

In at least one embodiment the strengthening composition is applied to a paper substrate by one or more of: a size press device, print roll coater device, air-knife coater device, metering bar coater device, blade coater device, under vacuum coater device, cast coating device, and any combination thereof. A representative size press device is described in U.S. Pat. No. 4,325,784. In at least one embodiment the application is performed by an on-machine operation or an off-machine operation. Other examples of coating devices, compositions added to the strengthening composition (after starch cooking), and synthetic polymers (which are present during and/or after starch cooking) are described in US Patent Application 2005/0155731.

In at least one embodiment the composition is applied to a filler-bearing paper substrate. The filler particles may be PCC, GCC, and any combination thereof.

In at least one embodiment the resulting paper has superior strength alongside more filler and/or superior optical properties despite having filler or optical property enhancing material in an amount that but for the cooking contact would have produced lessor strength. Optical properties include but are not limited to whiteness, brightness, and opacity all of which are defined as described in the reference *Measurement and Control of the Optical Properties of Paper,* $2^{nd}$ ed., Technidyne Corporation, New Albany, Ind., (1996).

EXAMPLES

The foregoing may be better understood by reference to the following examples, which are presented for purposes of illustration and are not intended to limit the scope of the invention.

Several laboratory experiments have been conducted to measure the ability of an AA/AcAm copolymer to increase the surface strength of paper. Except in study 3, base paper containing 16% ash and that has not been passed through a size press was coated using the drawdown method with solutions containing the desired chemistry. The paper was weighted before and after coating to determine specific chemical dose. The paper was dried by passing it once through a drum dryer at about 95° C. and allowed to equilibrate at 23° C. and 50% relative humidity for at least 12 hours.

Surface strength was measured using TAPPI (Technical Association of Pulp and Paper Industries) method T476 om-01. In this measurement, the surface strength is inversely proportional to the amount of mass lost from the surface of the paper after having been systematically "rubbed" on a turn table by two abrasion wheels. The results are reported in mg of lost material per 1000 revolutions (mg/1000 revs): the lower the number the stronger the surface.

Below is a summary of the studies conducted in the laboratory.

Study 1. Screening.

This first study was designed to determine which polymer performed the best among a set of samples varying in acrylic acid mole ratio and/or average molecular weight. Table 1 shows the conditions and the results.

TABLE 1

| Condition | Starch, lb/t | Polymer, lb/t | Acrylic acid/ acrylamide ratio | Average MW | Abrasion loss, mg/1000 revs |
|---|---|---|---|---|---|
| 1 | 14.8 | 0.00 | — | — | 1104.4 |
| 2 | 27.0 | 0.00 | — | — | 779.4 |
| 3 | 21.2 | 0.92 | 7.5/92.5 | Low | 856.7 |
| 4 | 20.5 | 0.89 | 7.5/92.5 | High | 804.4 |
| 5 | 19.6 | 0.85 | 15/85 | — | 765.6 |
| 6 | 19.1 | 0.83 | 30/70 | — | 798.3 |

The first two conditions span a range of starch dose within which the conditions containing the polymers will be dosed. The abrasion loss results demonstrate that the strongest surface is obtained with the copolymer containing 15% acrylic acid. The results of the two polymers containing 7.5% acrylic acid suggest that the higher average molecular weight polymer performs better.

Study 2. Monomer Ratio.

This study was designed to determine which polymer performed the best among a set of samples varying only in acrylic acid mole ratio. Table 2 shows the conditions and the results.

TABLE 2

| Condition | Acrylic acid/acrylamide ratio | Starch, lb/t | Polyacrylic acid/acrylamide, lb/t | Abrasion loss, mg/1000 revs |
|---|---|---|---|---|
| 1 | — | 15.0 | 0.00 | 441.7 |
| 2 | — | 25.9 | 0.00 | 262.5 |
| 3 | 7.5/92.5 | 19.2 | 0.83 | 321.7 |
| 4 | 15/85 | 19.8 | 0.86 | 207.5 |
| 5 | 30/70 | 18.9 | 0.82 | 285.8 |

The first two conditions are meant to span a range of starch dose within which the conditions containing the polymers will be dosed. The abrasion loss results demonstrate that the strongest surface is obtained with the copolymer containing 15% acrylic acid.

Study 3. Ash Replacement.

This study was designed to compare surface strength performance as a function of ash content. Controlling only for ash content, base sheets were prepare in the lab using a Noble and Wood mold, pressed in a static lab press and dried in a drum dryer at approximately 100° C. All wet end chemistries were maintained constant. Table 3 shows the conditions and the results.

TABLE 3

| Condition | Acrylic acid, %-Average MW, kDa | Starch, lb/t | Acrylic acid/ acrylamide, $lb_{actives}$/t | Ash, % | Abrasion loss, mg/ 1000 revs |
|---|---|---|---|---|---|
| 1 | — | 63.7 | 0.00 | 15.9 | 346 |
| 2 | — | 66.2 | 0.00 | 23.9 | 483 |
| 3 | 7.5-200 | 61.8 | 1.03 | 15.5 | 303 |
| 4 | 7.5-200 | 66.2 | 1.10 | 23.8 | 449 |
| 5 | 15-400 | 62.6 | 1.04 | 15.5 | 262 |
| 6 | 15-400 | 58.9 | 0.98 | 23.2 | 346 |

The first two conditions only contained starch, while the others contained about 1 lb/t of an AA/AcAm copolymer. The increase in surface strength is maximized with the higher average molecular weight copolymer containing 15% acrylic acid, Study 4. Cooking a Blend of Starch and AA/AcAm.

Table 4 illustrates a study designed to test the effect of cooking the starch in the presence of the AA/AcAm copolymer.

TABLE 4

| Condition | Starch and polymer cooked together? | Starch, lb/t | AA/AcAm, lb/t | Abrasion loss, mg/1000 revs |
|---|---|---|---|---|
| 1 | No | 21.3 | 0.00 | 1156 |
| 2 | No | 31.2 | 0.00 | 1034 |
| 3 | No | 37.2 | 0.00 | 880 |
| 4 | No | 16.4 | 1.09 | 1064 |
| 5 | No | 24.4 | 1.06 | 924 |
| 6 | No | 31.8 | 1.06 | 794 |
| 7 | Yes | 15.9 | 1.06 | 944 |
| 8 | Yes | 22.5 | 0.98 | 759 |
| 9 | Yes | 30.1 | 1.00 | 588 |

The results of these tests demonstrate that the formulation where the starch was cooked in the presence of a synthetic polymer such as AA/AcAm copolymer performs better than the formulation where the blending was done after cooking the starch.

While this invention may be embodied in many different forms, there are described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and/or incorporated herein. In addition the invention encompasses any possible combination that also specifically excludes any one or some of the various embodiments described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6,1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range. All percentages, ratios and proportions herein are by weight unless otherwise specified.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of coating a paper substrate, the method comprising the steps of:

forming a composition by contacting starch and a synthetic polymer during a starch cooking process in a fluid, the fluid being at temperature and conditions such that the starch remains insolubly suspended in the fluid, cooking the composition under temperature and conditions sufficient to gelatinize the starch and to open up the starch to water penetration and to form a complex with the synthetic polymer but the temperature and pressure being insufficient to form covalent bonds between the starch and the synthetic polymer, and applying the composition to a paper substrate, wherein the composition excludes pigment and the synthetic polymer is not a starch, and wherein the composition is applied to a paper substrate by one device selected from the list consisting of: a size press device, print roll coater device, air-knife coater device, metering bar coater device, blade coater device, under vacuum coater device, cast coating device, and any combination thereof.

2. The method of claim 1 in which the contact occurs after the starch cooking process has begun.

3. The method of claim 1 in which the contact occurs before the starch cooking process has begun.

4. The method of claim 1 in which the synthetic polymer is a copolymer formed from monomer units of both acrylic acid and acrylamide.

5. The method of claim 1 in which the starch is a solid before it is cooked.

6. The method of claim 1 in which the composition has a viscosity greater than a composition in which the polymer only enters the composition after the starch has been cooked.

7. The method of claim 1 in which the paper substrate comprises filler particles.

8. The method of claim 7 in which a paper product made from the paper substrate has a greater surface strength than a paper product similarly made but in which a smaller amount of filler was present and the polymer was added to the composition after cooking.

9. The method of claim 1 in which a paper product made from the paper substrate has a greater strength than a paper product made from the same materials but with a smaller amount of starch and in which the polymer was added to the composition after cooking.

10. A sheet of paper made from a papermaking process which includes the process of claim 1.

* * * * *